US007909420B2

(12) United States Patent
Jährling

(10) Patent No.: US 7,909,420 B2
(45) Date of Patent: Mar. 22, 2011

(54) PULL-OUT GUIDE FOR DISH RACK OF A DISHWASHER

(75) Inventor: Peter Jährling, Bünde (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 329 days.

(21) Appl. No.: 12/161,768

(22) PCT Filed: Feb. 27, 2007

(86) PCT No.: PCT/EP2007/051852

§ 371 (c)(1),
(2), (4) Date: Jul. 22, 2008

(87) PCT Pub. No.: WO2007/101806

PCT Pub. Date: Sep. 13, 2007

(65) Prior Publication Data

US 2009/0096338 A1 Apr. 16, 2009

(30) Foreign Application Priority Data

Mar. 3, 2006 (DE) ..... 20 2006 003 556 U

(51) Int. Cl.
*A47B 81/02* (2006.01)

(52) U.S. Cl. ..... 312/228.1; 312/334.8; 312/351; 211/41.8

(58) Field of Classification Search ..... 312/408, 312/410, 228.1, 334.7–334.11, 351, 111; 134/135; 211/41.3, 41.4, 41.8, 41.9, 126.15, 211/126.9, 133.5

See application file for complete search history.

(56) References Cited

U.S. PATENT DOCUMENTS

| | | | | |
|---|---|---|---|---|
| 3,472,573 | A * | 10/1969 | Geiger | 312/351 |
| 3,726,580 | A * | 4/1973 | Guth | 312/351 |
| 3,809,450 | A * | 5/1974 | Guth | 312/351 |
| 4,070,076 | A * | 1/1978 | Zwillinger | 312/350 |
| 5,474,378 | A * | 12/1995 | Smith et al. | 312/334.4 |
| 5,657,878 | A * | 8/1997 | Austin | 211/41.8 |
| 5,860,716 | A * | 1/1999 | Good et al. | 312/311 |
| 6,467,860 | B2 * | 10/2002 | Remmers | 312/334.7 |
| 6,643,900 | B2 * | 11/2003 | Jahrling | 24/563 |

(Continued)

FOREIGN PATENT DOCUMENTS

DE 3025311 1/1982

(Continued)

OTHER PUBLICATIONS

International Search Report for International Patent Application No. PCT/EP2007/051852, dated Jul. 11, 2007.

*Primary Examiner* — Hanh V Tran
(74) *Attorney, Agent, or Firm* — Barnes & Thornburg LLP

(57) ABSTRACT

A pull-out guide for a dish rack of a dishwasher includes a guide rail which can be fixed to the body of a dishwasher, and a running rail which can be connected to a grid-like dish rack which is composed of wires, and a central rail which increases the pull-out length. The running rail is provided with two rows of clamp-like holders which lie one above the other and in which two wires of a dish rack which lie one above the other and run horizontally can be fixed, with the result that the dish rack is held in a dimensionally stable manner.

9 Claims, 12 Drawing Sheets

U.S. PATENT DOCUMENTS

| | | | | |
|---|---|---|---|---|
| 6,974,040 | B2 * | 12/2005 | Jahrling | 211/41.8 |
| 7,001,004 | B2 * | 2/2006 | Bartloff et al. | 312/334.45 |
| 7,410,228 | B2 * | 8/2008 | Dickson et al. | 312/311 |
| 2001/0044992 | A1 | 11/2001 | Jährling | |
| 2004/0103932 | A1 * | 6/2004 | Kim | 134/137 |
| 2005/0104488 | A1 * | 5/2005 | Hunt et al. | 312/228.1 |
| 2005/0133469 | A1 * | 6/2005 | Mersch et al. | 211/41.8 |

FOREIGN PATENT DOCUMENTS

| | | | | |
|---|---|---|---|---|
| DE | 4227585 | * | 2/1994 | 134/135 |
| KR | 20040008344 | | 1/2004 | |

* cited by examiner

PULL-OUT GUIDE FOR DISH RACK OF A DISHWASHER

BACKGROUND AND SUMMARY

The present invention relates to a pull-out guide for a dish rack of a dishwasher, which includes a guide rail, which can be secured on the basic structure of the dishwasher, and a running rail, which can be connected to a grid-like dish rack including wires, and a center rail, which increases the pull-out length.

A number of embodiments of pull-out guides of the generic type are known.

Dish racks of dishwashers, in the fully loaded state, may have a high overall weight, which has to be supported by the pull-out guides on both longitudinal sides of the dish rack. Accordingly, the question of how to fasten a dish rack on the running rails of pull-out guides has a lot of importance attached to it.

It is not just a matter here of meeting the fundamental requirement of making it possible for a dish rack to be reliably retained by the pull-out guides even in the fully loaded state; rather, it is also sought for the dish rack to be retained in as stable a position as possible even when the pull-out guide has been pulled out to the full extent.

Thus, the invention provides a pull-out guide, which ensures that a dish rack of a dishwasher is retained in a dimensionally stable and largely torsionally rigid manner, particularly when the pull-out guide has been pulled out to the full extent.

This object is achieved according to the invention in that the running rail is provided with two rows of clamp-like retaining means, located one above the other, in which can be secured two horizontally running wires of a dish rack, the wires being located one above the other.

This design results in load dissipation of the weight of the dish rack to a pull-out guide which extends over a long length, as seen in the direction of displacement of the pull-out guide, and also takes place in two different planes, in which case a dish rack is retained in an extremely dimensionally stable and inherently rigid manner. Since the retaining means form a constituent part of the running rail, this also results, from the point of view of installation, in an extremely straightforward mechanism of fastening a dish rack on a corresponding running rail.

Depending on the configuration of the retaining means, it may possibly also be necessary, for position-securing purposes, to use one or more clamps, which ensure a form-fitting connection between the dish rack and a running rail. These additional retaining clamps, however, serve merely for fixing the position of the dish rack relative to the running rail, and are not subjected to loading by the forces transmitted to the running rail from the dish rack.

BRIEF DESCRIPTION OF THE DRAWINGS

Illustrated embodiments of the invention will be described in more detail hereinbelow and are illustrated in the accompanying drawings, in which.

DETAILED DESCRIPTION

Figure 1:
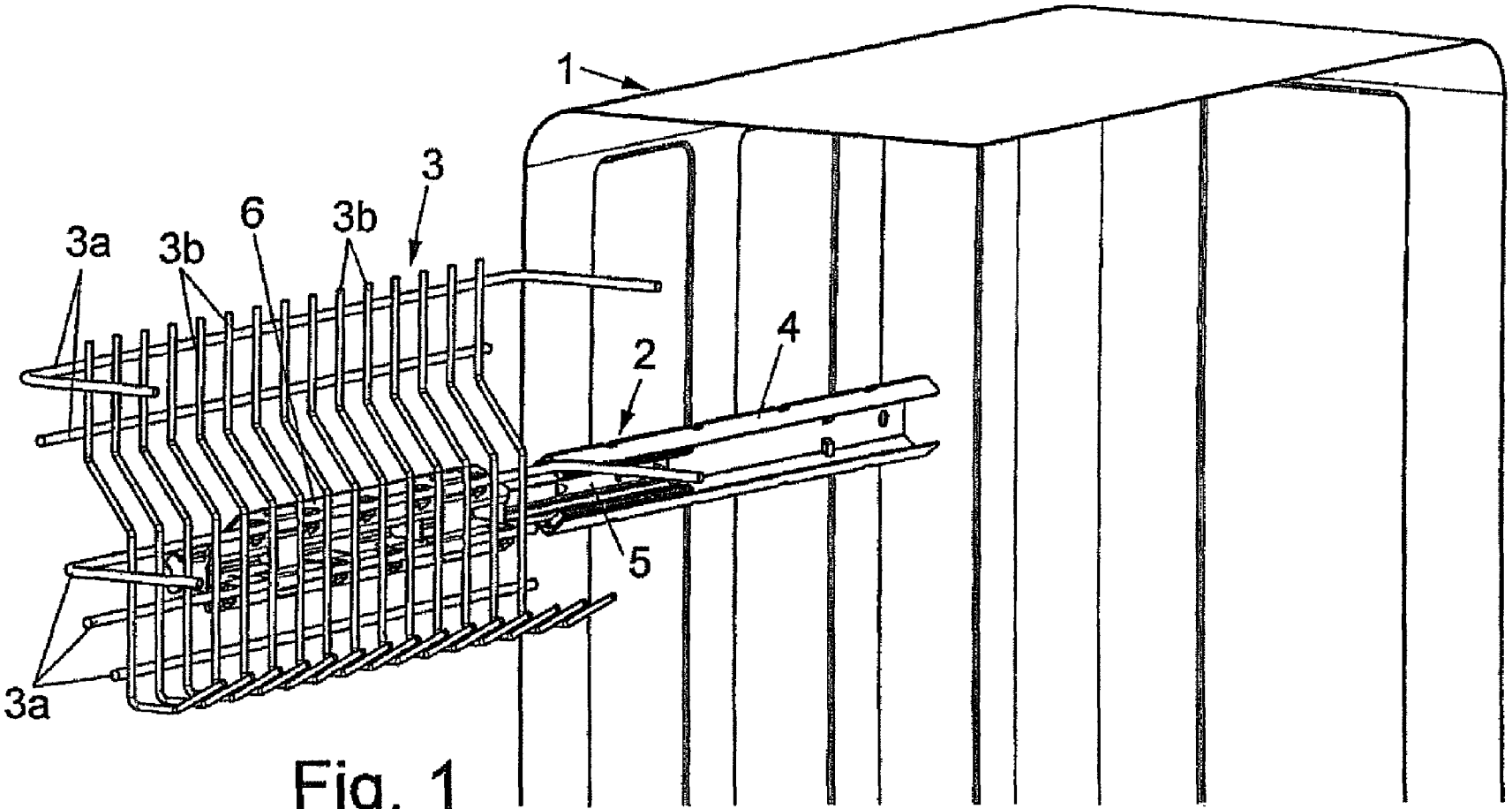
FIG. 1 shows a highly schematic illustration, in perspective, of a dishwasher with a pull-out guide which is fastened therein and carries a dish rack.
Figure 2:
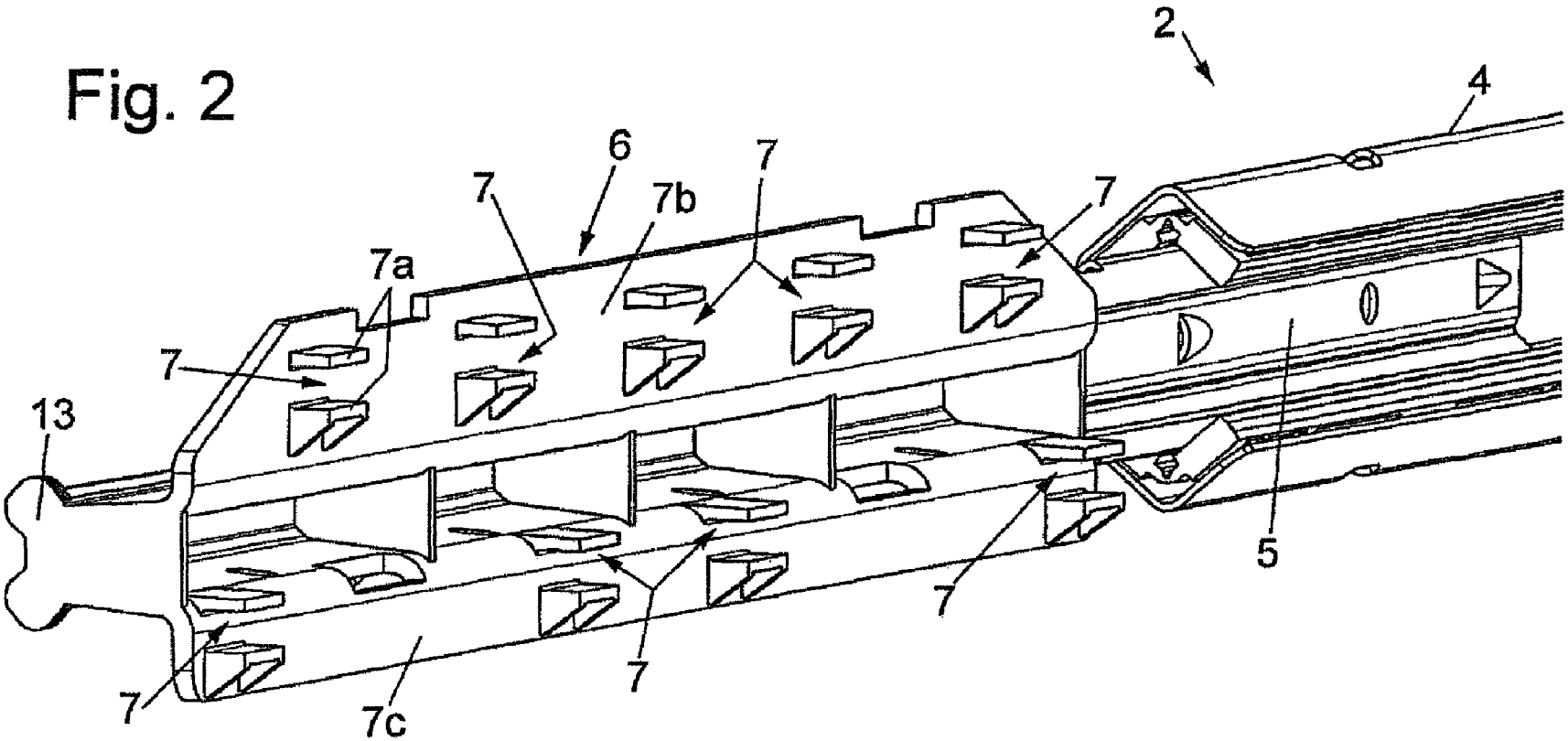
FIG. 2 shows, on an enlarged scale in relation to FIG. 1, a partial illustration in particular of a running rail of the pull-out guide, as seen from the side of the dish rack.
Figure 3:
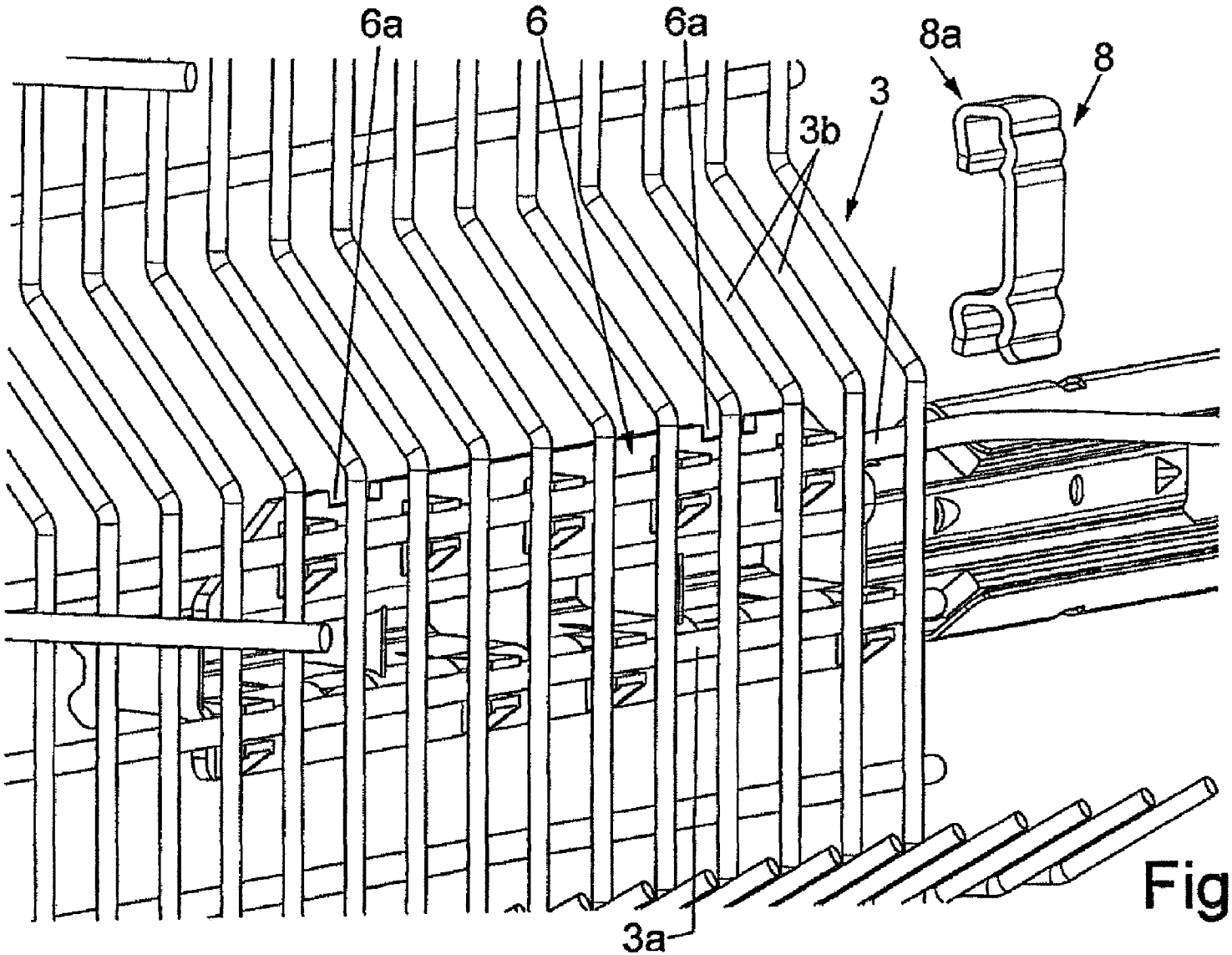
FIG. 3 shows, on an enlarged scale in relation to FIG. 1, an illustration of the region of connection between the dish rack and the running rail, prior to a retaining clamp being fitted in order to fix the position of the dish rack relative to the running rail.

In FIG. 1, 1 is used to designate, in a highly schematic illustration, a dishwasher in which a dish rack 3 is guided in a longitudinally displaceable manner via a pull-out guide, which is designated overall by 2.

The pull-out guide 2 comprises a guide rail 4, a center rail 5 and a running rail 6, the center rail 5 increasing a pull-out length of the pull-out guide 2 to the effect that the dish rack 3 can be pulled all the way out in front of the basic structure of the dishwasher 1, as is indicated in FIG. 1.

The dish rack 3 includes wires, and has a plurality of horizontally running wires 3*a* and a multiplicity of wires 3*b*, which are connected to the wires 3*a* and determine the shape of the dish rack 3. Such a construction of a dish rack is known in general and, to this extent, need not be explained in any more detail here.

In conjunction with the present invention, the running rail 6 of the pull-out guide 2 is provided with two rows, of clamp-like retaining means 7 which, are located one above the other. In the case of the illustrated embodiment according to FIGS. 1-7, the guide 2 has a substantially C-shaped cross section and can thus be positioned in the horizontal direction on two parallel and horizontally running wires 3*a* of the dish rack 3, the wires being located at equal intervals one above the other. The C-shaped retaining means 7 are bounded in each case by a bottom and a top flange 7*a* and are closed off in the rear side by wall parts 7*b* or 7*c* of the running rail 2. This results in the above-mentioned cross-section in the C-shaped configuration of these retaining means 7. The rows of the retaining means 7, as has already been mentioned, are spaced apart from one another by the same interval as two horizontal wires 3*a* of a dish rack 3 which are located one above the other. Moreover, the rows of the retaining means 7 run substantially over the entire length of the running rail 6, and this results, overall, in a dish rack being retained in a very stable and torsionally rigid manner relative to the running rail 6.

To avoid undesired relative displacement between the dish rack 3 and running rail 6, use can be made of at least one retaining clamp 8, which engages over the horizontally running wires 3*a* from the side directed away from the running rail 6 and is clipped on the bottom of the two horizontal wires 3*a*, for example, and has its top end region, which is formed as a securing hook 8*a*, engaging in the top peripheral region of the running rail 6, in a notched portion 6*a* which is provided there. Moreover, the width of the retaining clamp 8 is selected such that it corresponds to the clear distance between two adjacent wires 3*b* of the dish rack 3, these wires running at right angles to the horizontal wires 3*a*, and is located between two adjacent wires 3*b*. This ensures a form-fitting coupling between the running rail 6, on the one hand, and the dish rack 3, on the other hand.

One such retaining clamp 8 would suffice to fix the dish rack relative to the running rail 6, but unavoidable tolerances mean that it is expedient to use two such retaining clamps 8 in the end regions of the running rail 6, as is shown in the illustrated embodiments according to FIGS. 1-7.

Figure 4:
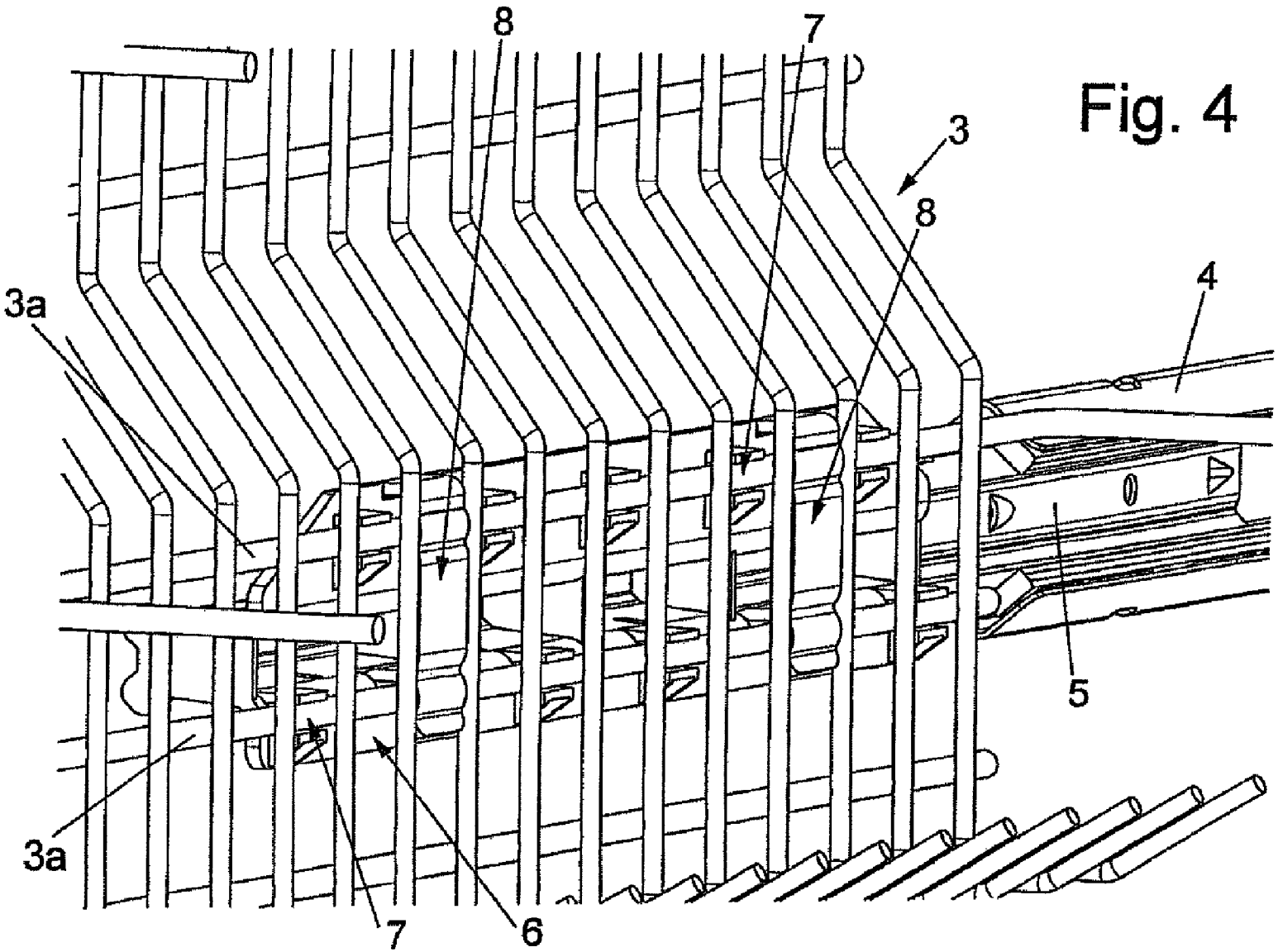
FIG. 4 shows an illustration corresponding to FIG. 3, with the retaining clamp in the operative position.
Figure 5:
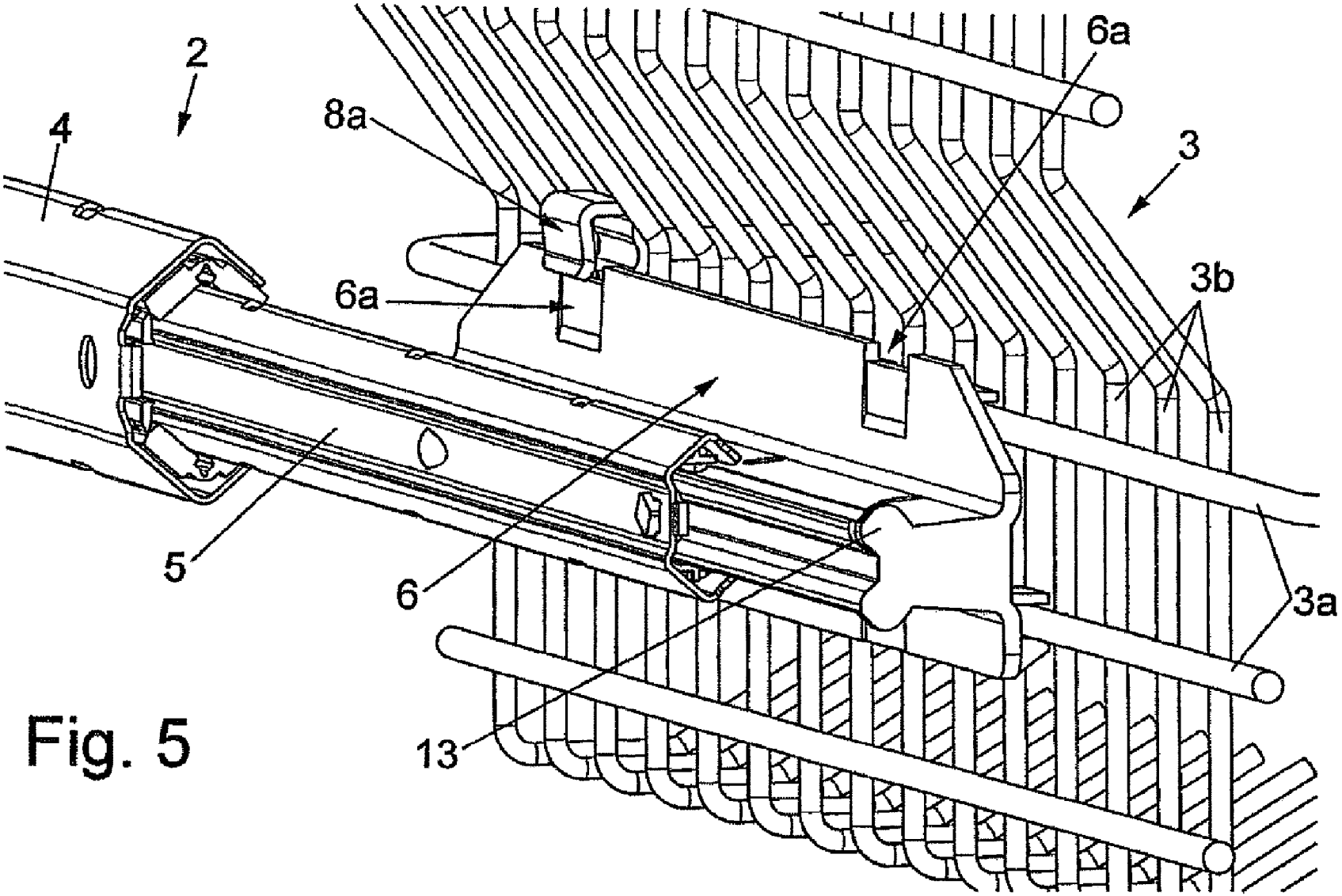
FIG. 5 shows a rear view of the pull-out guide prior to a retaining clamp being fitted.
Figure 6:
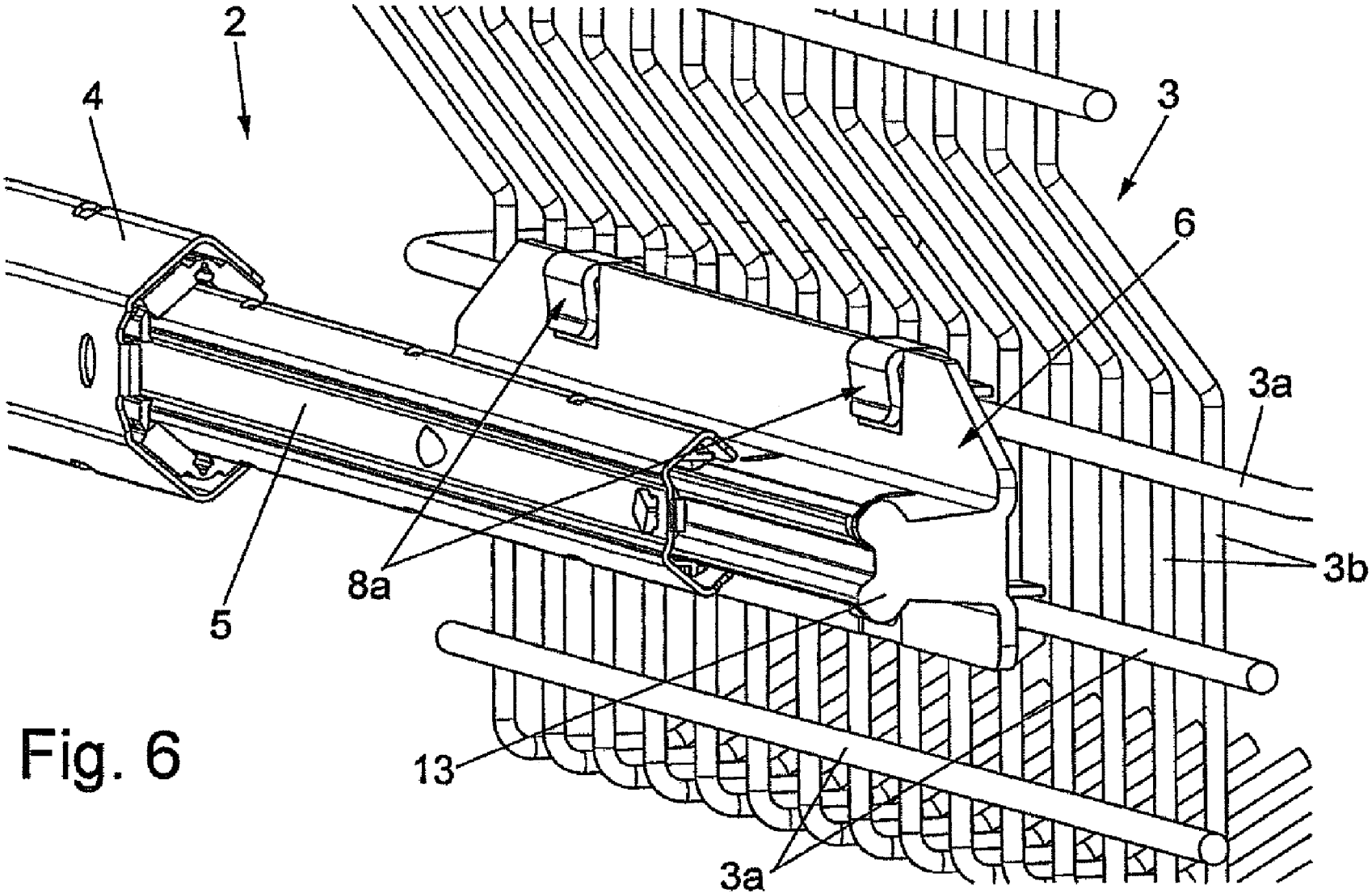
FIG. 6 shows a rear view corresponding to FIG. 5, with retaining clamps fitted.
Figure 7:
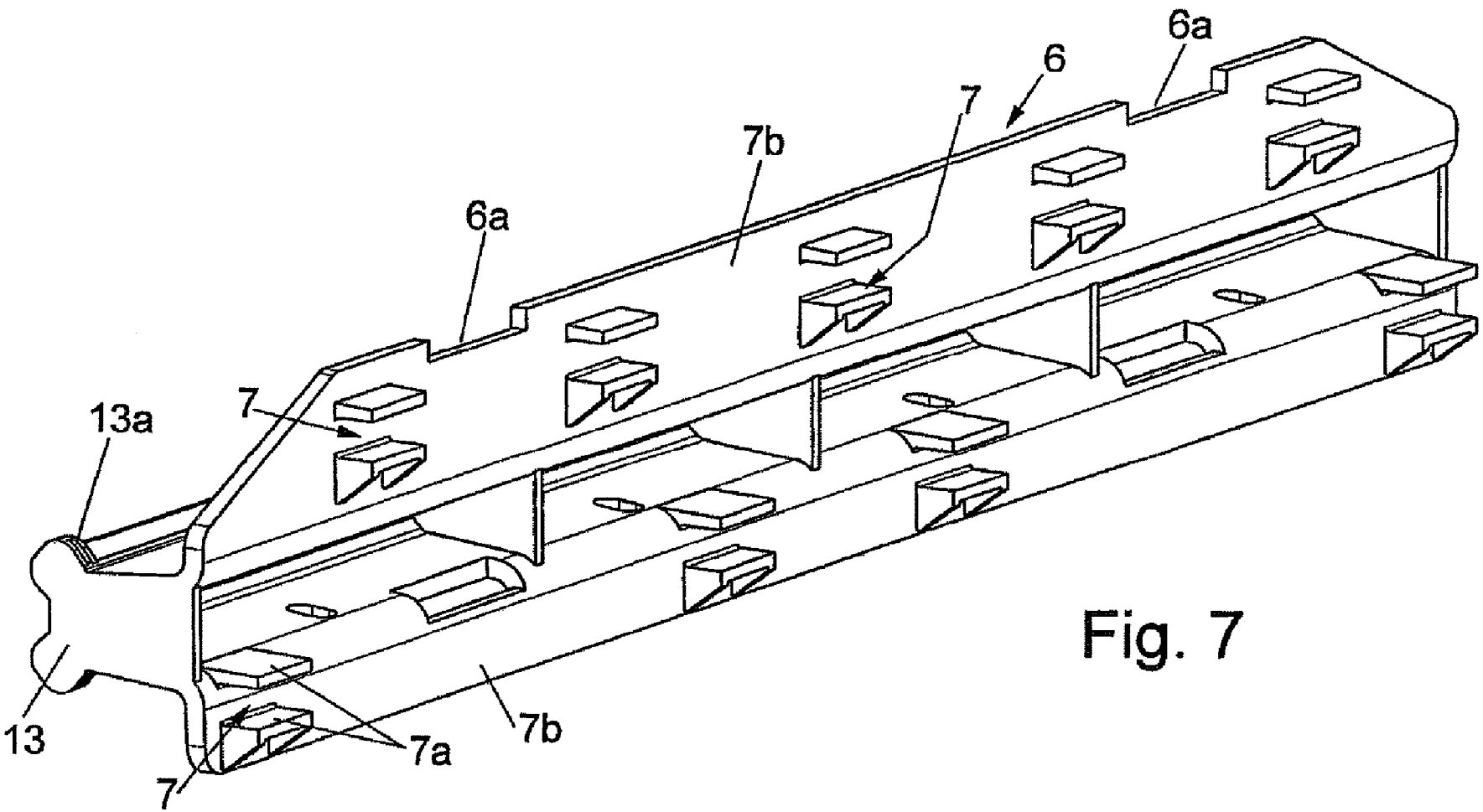
FIG. 7 shows a perspective illustration exclusively of the running rail of a pull-out guide according to FIGS. 1-6.

FIG. 4 shows two such retaining clamps 8 in the installed state; FIG. 5 shows, as seen from the rear side of the running rail 6, the installation situation of such a retaining clamp 8 shortly prior to connection to the running rail 6, while FIG. 6 shows two retaining clamps 8 in the definitively installed state.

In the case of the illustrated embodiment of the invention according to FIGS. 8-12, the same components as in the illustrated embodiment according to FIGS. 1-7 have been provided with the same designations.

Figure 8:
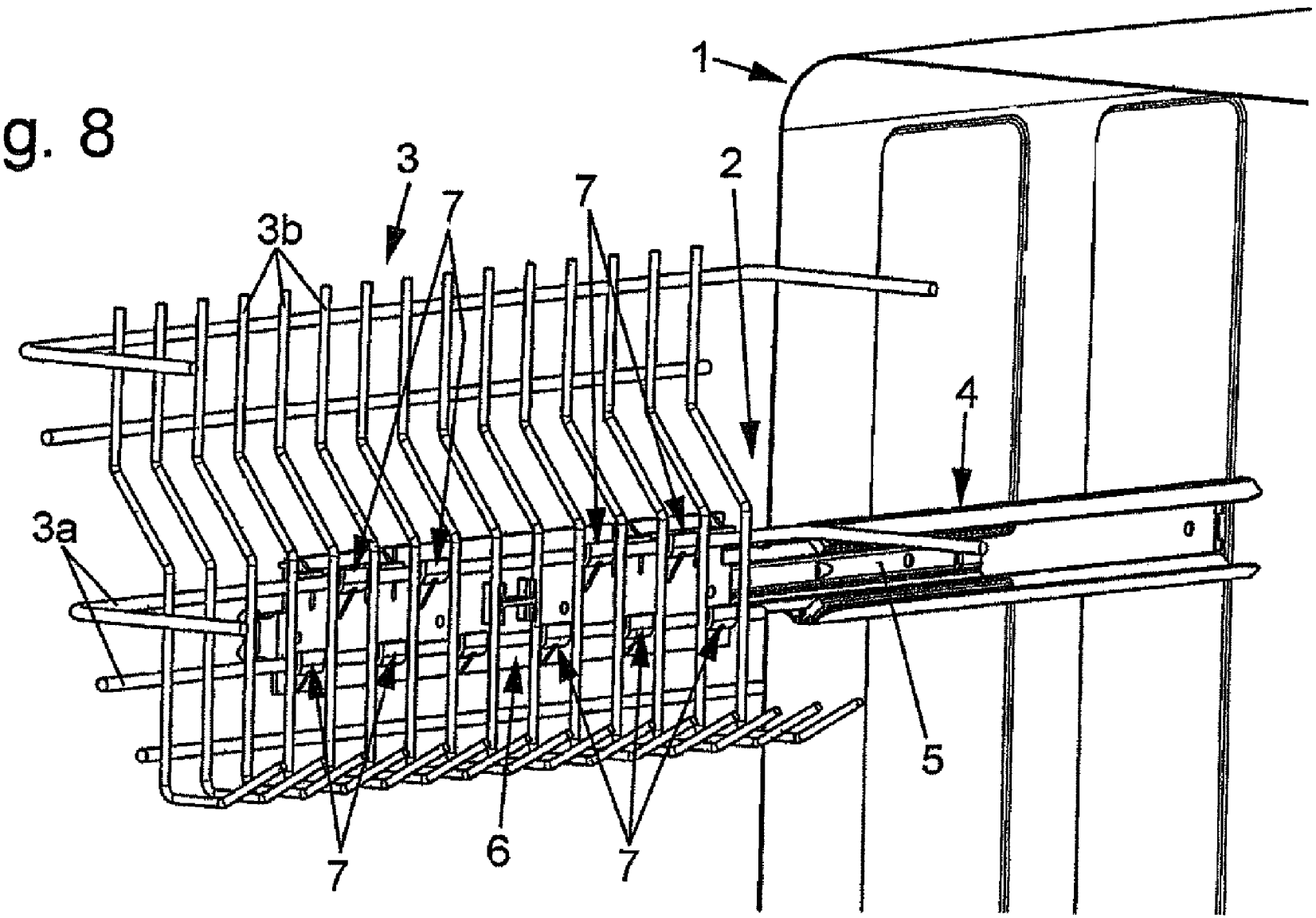
FIG. 8 shows an illustration which corresponds essentially to FIG. 1 and depicts a further illustrated embodiment of the invention.
Figure 9:
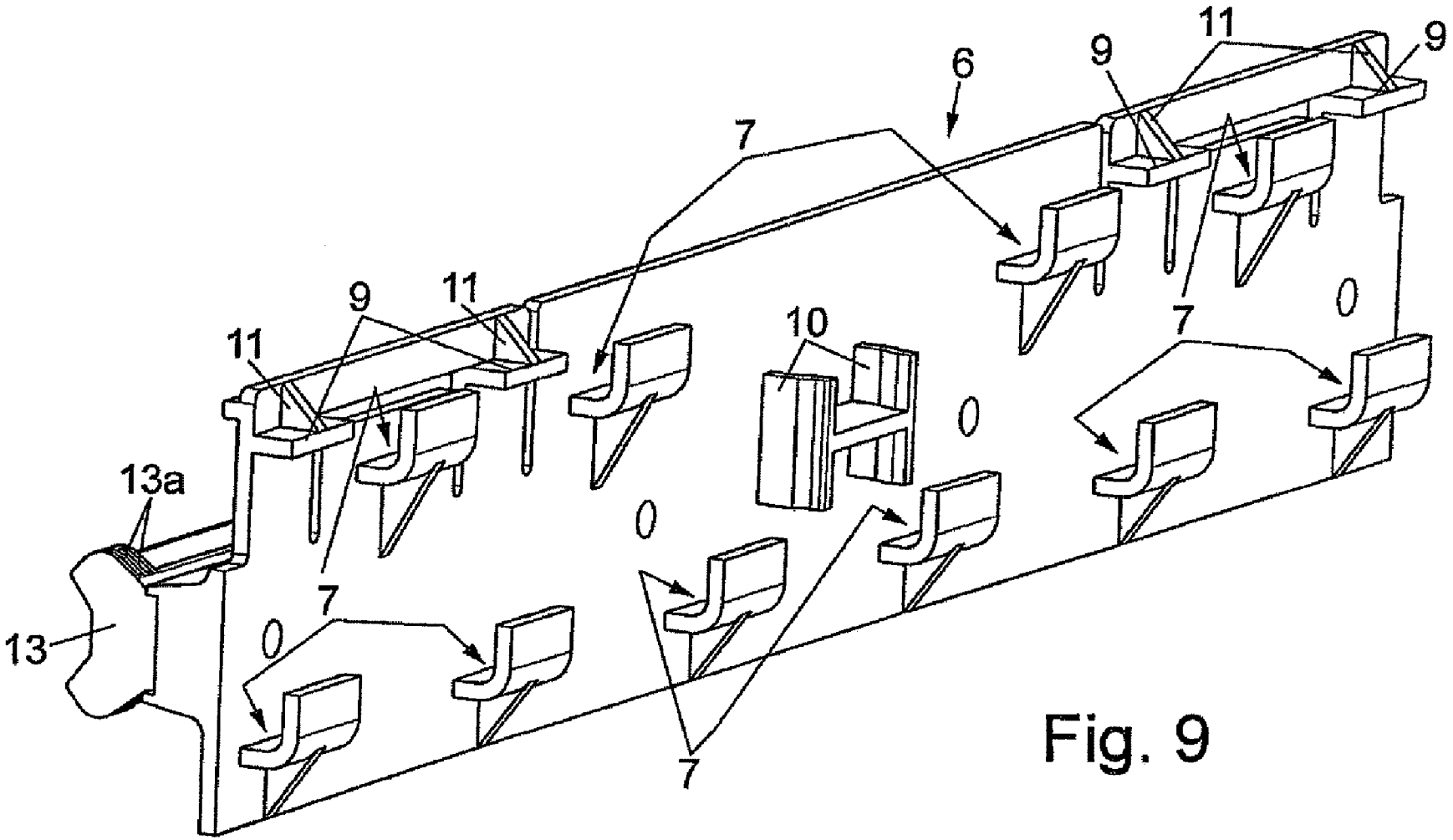
FIG. 9 shows a perspective illustration of the running rail of the pull-out guide according to FIG. 8.
Figure 10:
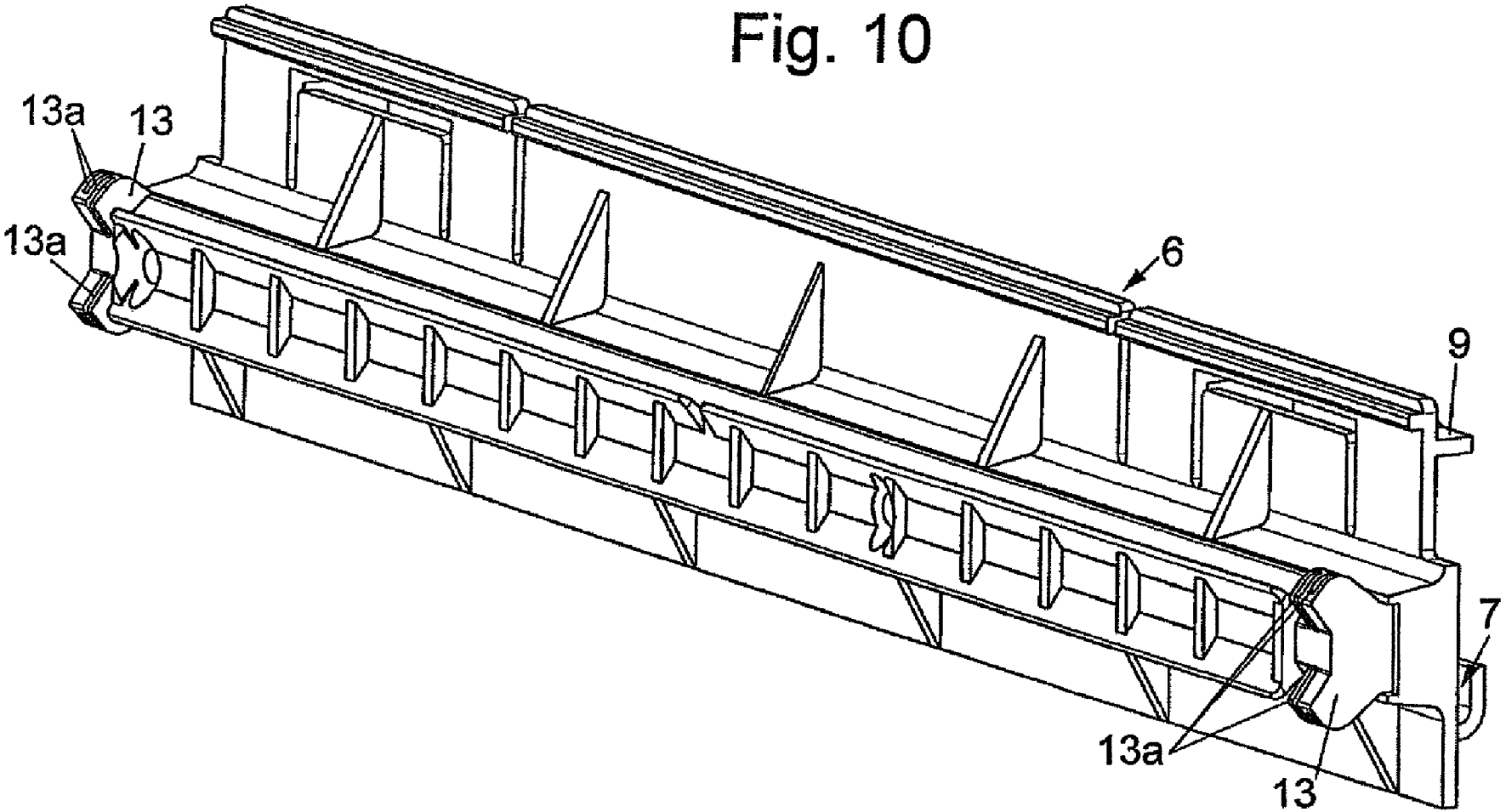
FIG. 10 shows a rear view of the running rail according to FIG. 9.
Figure 11:
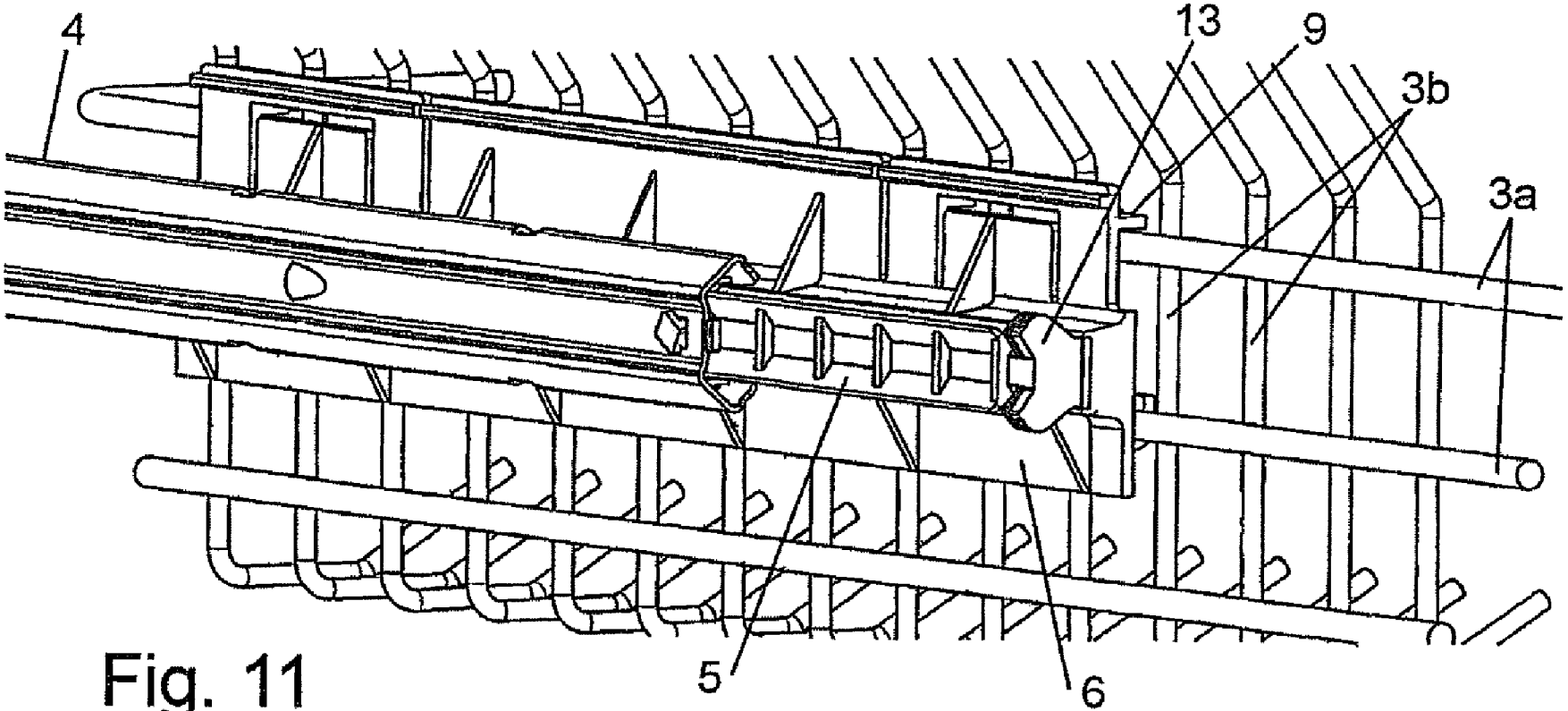
FIG. 11 shows a rear view of the pull-out guide according to FIG. 8 with the dish rack fastened on the running rail.
Figure 12:
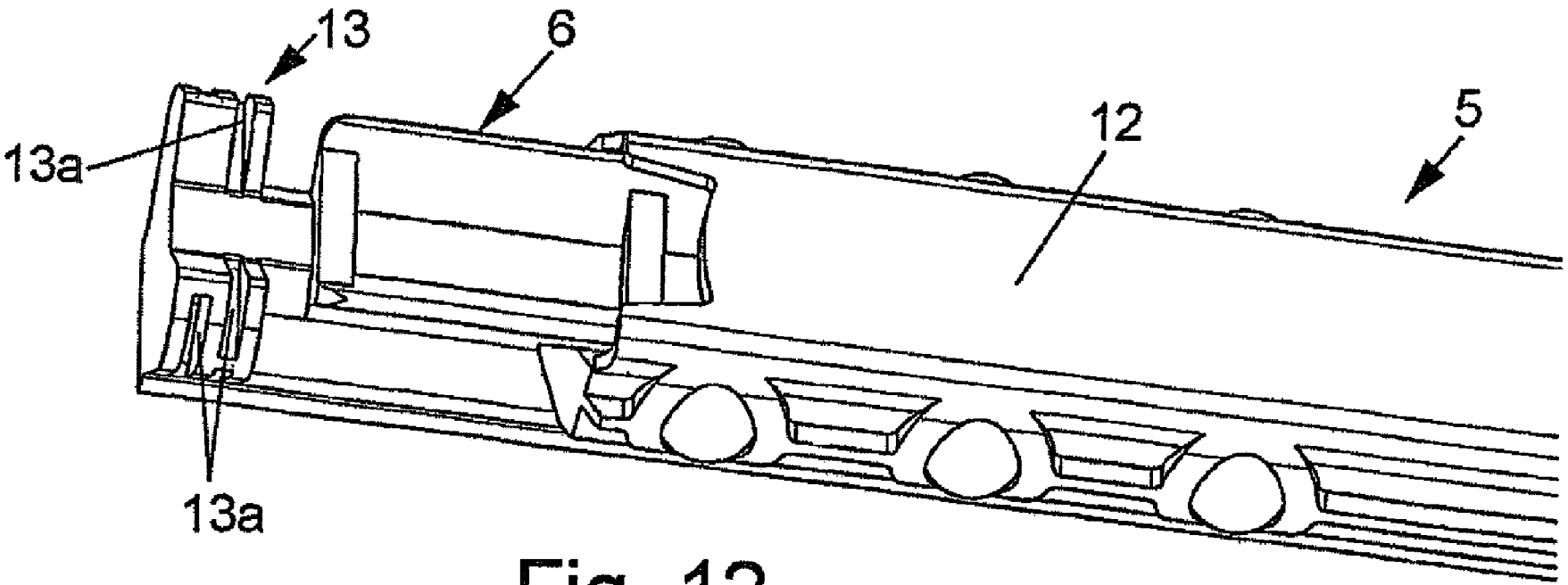
FIG. 12 shows a partial view of the front end region of a running rail according to FIGS. 8-11 with the corresponding front end of a ball cage for guiding a center rail, which increases the pull-out length.

As can clearly be seen in FIG. 8, a dish rack 3 is guided in a dishwasher 1 such that it can be displaced longitudinally via a telescopic pull-out guide 2. The pull-out guide 2, in turn, includes a guide rail 4, which can be secured on the basic structure of the dishwasher 1, a running rail 6, on which the dish rack 3 is retained, and a center rail 5, which increases the pull-out length.

The significant difference of the illustrated embodiment according to FIGS. 8-12 in relation to the illustrated embodiment according to FIGS. 1-7 is that the clamp-like retaining means 7 have a substantially U-shaped cross section, in which case the horizontally running wires 3*a* of the dish rack 3 can be introduced in the vertical direction into these clamp-like retaining means.

To prevent the dish rack 3 from being raised up accidentally, securing lugs 9 are preferably provided in the region of the top row of the retaining means 7, these securing lugs positioning themselves in the horizontal direction over a horizontally running wire 3*a* introduced into the top row of the retaining means 7, and being capable of being angled laterally as a whole out of this locking position and otherwise being connected to the running rail 6.

This means that a vertical movement of the dish rack 3 relative to the running rail 6 is prevented in practice. To avoid longitudinal displacement of the dish rack 3 and the running rail 6 relative to one another, the running rail 6 is provided, on its side which is directed toward the dish rack 3, this being shown particularly clearly in FIG. 9, with two supporting side pieces 10 which project in the direction of the dish rack 3 and, in the installed state, position themselves between two wires 3*b* of the dish rack. Overall, this is an extremely straightforward way of fixing the dish rack 3 in a form-fitting manner in relation to the running rail 6.

To make it easier for a horizontally running wire 3*a* of a dish rack 3 to be introduced into the top row of the retaining means 7, the securing lugs 9 are provided, on their top sides, with wedge-shaped guide webs 11. As a result of this configuration, a horizontally running wire 3*a* of a dish rack 3 first of all pushes the securing lugs 9 out of the region of introduction into the retaining means 7 to the extent that the horizontally running wire 3*a* can be introduced into these retaining means 7. When the wire 3*a* then moves below the bottom plane of the securing lugs 9, the latter are no longer subjected to lateral deflection and move back into their securing position.

In both illustrated embodiments, the running rail 6 is in the form of a single-piece plastic part.

The running rail 6 here is dimensioned such that that region of the running rail 6 which is directed toward the dish rack 3, in the pushed-in state, substantially completely covers the guide rail 4, which is mounted on the basic structure of the dishwasher, and the center rail 5, which increases the pull-out length. This reduces the risk of these rail parts becoming contaminated.

Moreover, in both illustrated embodiments, a stop lamella 13 located in the displacement path of a ball cage 12 of the center rail 5 (see FIG. 12) is integrally formed at least at the front end of the running rail 6, this stop lamella being provided with a certain amount of resilience by a plurality of incisions 13*a*. This stop lamella 13 provides a damping end stop for the ball cage 12. It is possible for the stop lamella 13 to be extruded on to the running rail from a relatively soft plastic or to be fitted thereon in the form of a separate component.

As a result of the fact that a dish rack 3 is connected to the running rail 6 via two horizontally running wires 3*a* located one above the other, the connection is provided with a high level of stability, and is distinguished in particular by high torsional rigidity. This makes it advantageously possible, without having to accept any stability-related problems, to use relatively thin wires 3*a* and 3*b* in the production of a dish rack 3, as a result of which both the production costs and the weight of the dish rack 3 itself can be lowered.

The invention claimed is:

1. A pull-out guide for a dish rack of a dishwasher, the pull-out guide comprising:

a guide rail, configured to be secured on a dishwasher, and a running rail, configured to be connected to a grid-like dish rack comprising wires, and a center rail, and which is configured to increase the pull-out length, wherein the running rail is provided with two rows of clamp-like retaining means, the two rows being positioned one above the other, and wherein the two rows of clamp-like retaining means are secured to two horizontally running wires of a dish rack, wherein the clamp-like retaining means have a substantially C-shaped cross section and are configured to be pushed in a horizontal direction onto the horizontally running wires, the running rail is secured by at least one retaining clamp, which engages over the horizontally running wires from a side directed away from the running rail and is secured on the running rail, so as to prevent the dish rack being released unintentionally from the running rail, said;

retaining clamp has a bottom end clipped to a corresponding horizontally running wire connected to the running rail and has a top end, which is formed as a securing hook engaging over the running rail.

2. The pull-out guide of claim 1, wherein the securing hook engages over the running rail in a region of a notched portion.

3. The pull-out guide of claim 1, further comprising a stop lamella located in a region of displacement of a ball cage of the center rail, wherein the stop lamella is integrally formed at least at a front end of the running rail.

4. The pull-out guide of claim 3, further comprising one or more incisions configured and positioned to render the stop lamella capable of resilience and damping.

5. The pull-out guide of claim 1, wherein the side region of the running rail directed toward the dish rack is of a large enough dimensions to cover the guide rail and the center rail.

6. A pull-out guide for a dish rack of a dishwasher, the pull-out guide comprising:

a guide rail, configured to be secured on a dishwasher, and a running rail, configured to be connected to a grid-like dish rack comprising wires, and a center rail, and which is configured to increase the pull-out length, wherein the running rail is provided with two rows of clamp-like retaining means, the two rows being positioned one above the other, and wherein two rows of clamp-like retaining means are secured to two horizontally running wires of a dish rack, wherein the clamp-like retaining means have a substantially C-shaped cross section and are configured to be pushed in a horizontal direction onto the horizontally running wires, wherein the running rail is secured by at least one retaining clamp, which engages over the horizontally running wires from a side directed away from the running rail and is secured on the running rail so as to prevent a situation where the dish rack is released unintentionally from the running rail, and wherein said at least one retaining clamp has a width which corresponds to a distance between two adjacent wires running at an angle to the horizontally running wires, and wherein each of the at least one retaining clamp is located in a form-fitting manner between two adjacent wires.

7. The pull-out guide of claim 6, further comprising a stop lamella located in a region of displacement of a ball cage of the center rail, wherein the stop lamella is integrally formed at least at a front end of the running rail.

8. The pull-out guide of claim 7, further comprising one or more incisions configured and positioned to render the stop lamella capable of resilience and damping.

9. The pull-out guide of claim 6, wherein the side region of the running rail directed toward the dish rack is of a large enough dimensions to cover the guide rail and the center rail.

* * * * *